US011168374B2

(12) United States Patent
Kapl et al.

(10) Patent No.: US 11,168,374 B2
(45) Date of Patent: Nov. 9, 2021

(54) TILTABLE EXCHANGEABLE METALLURGICAL VESSEL AND METHOD FOR FIXING AND RELEASING A TILTABLE METALLURGICAL VESSEL

(71) Applicant: Primetals Technologies Austria GmbH, Linz (AT)

(72) Inventors: Robert Kapl, Bad Leonfelden (AT); Helmut Lechner, Linz (AT); Gerald Wimmer, Linz (AT)

(73) Assignee: PRIMETALS TECHNOLOGIES AUSTRIA GMBH, Linz (AT)

( * ) Notice: Subject to any disclaimer, the term of this patent is extended or adjusted under 35 U.S.C. 154(b) by 0 days.

(21) Appl. No.: 16/770,426

(22) PCT Filed: Dec. 19, 2018

(86) PCT No.: PCT/EP2018/085747
§ 371 (c)(1),
(2) Date: Jun. 5, 2020

(87) PCT Pub. No.: WO2019/121858
PCT Pub. Date: Jun. 27, 2019

(65) Prior Publication Data

US 2020/0385828 A1 Dec. 10, 2020

(30) Foreign Application Priority Data

Dec. 20, 2017 (EP) ..... 17209051

(51) Int. Cl.
*C21C 5/46* (2006.01)
*C21C 5/50* (2006.01)

(52) U.S. Cl.
CPC ..... *C21C 5/4633* (2013.01); *C21C 5/4673* (2013.01); *C21C 5/50* (2013.01)

(58) Field of Classification Search
None
See application file for complete search history.

(56) References Cited

U.S. PATENT DOCUMENTS 4,191,364 A * 3/1980 Montgomery ..... C21C 5/4633 266/246
7,871,560 B2 1/2011 Best et al.
(Continued)

FOREIGN PATENT DOCUMENTS

CN 2820875 Y 9/2006
CN 202945265 U 5/2013
(Continued)

OTHER PUBLICATIONS

International Search Report and Written Opinion received in PCT/EP2018/085747 dated Jan. 28, 2019, p. 17.
(Continued)

*Primary Examiner* — Scott R Kastler
(74) *Attorney, Agent, or Firm* — Liang & Hennessey LLP; Brian Hennessey

(57) ABSTRACT

The invention relates to the subject area of metallurgical systems, in particular a metallurgical vessel which is fixed on a support ring. The object of the invention is to provide a metallurgical vessel having a support ring and a method for fixing and releasing, which prevents constraint forces. The tiltable metallurgical vessel having a round cross-section is at least partially surrounded by a support ring. The support ring is at a distance from the metallurgical vessel in the radial direction. The metallurgical vessel has at least three brackets, each having a respective pin. The support ring has at least three receiving openings which receive the pins. These receiving openings permit a shifting of the pin in the radial direction. The pins are secured against falling out of the receiving opening and the bracket by at least three
(Continued)

locking devices floatingly mounted and arranged inside the support ring.

15 Claims, 5 Drawing Sheets

(56) References Cited

U.S. PATENT DOCUMENTS

| | | | | |
|---|---|---|---|---|
| 2008/0265474 | A1* | 10/2008 | Gruber | C21C 5/4633 266/276 |
| 2020/0385828 | A1* | 12/2020 | Kapl | C21C 5/4633 |

FOREIGN PATENT DOCUMENTS

| | | | |
|---|---|---|---|
| CN | 103998628 | A | 8/2014 |
| CN | 206721253 | U | 12/2017 |
| DE | 2457606 | A1 | 6/1975 |
| DE | 102013224072 | A1 | 6/2014 |
| EP | 1533389 | A1 | 5/2005 |

OTHER PUBLICATIONS

European Search Report received in 17209051.6 dated Mar. 28, 2018, p. 10.
Chinese Office Action received in 201880082673.2 dated May 24, 2021, pp. 1-25.
India Office Action received in 202017022164 dated Aug. 23, 2021, pp. 1-6.

* cited by examiner

TILTABLE EXCHANGEABLE METALLURGICAL VESSEL AND METHOD FOR FIXING AND RELEASING A TILTABLE METALLURGICAL VESSEL

CROSS-REFERENCE TO RELATED APPLICATIONS

The present application is a national phase application of PCT Application No. PCT/EP2018/085747, filed Dec. 19, 2018, entitled "TILTABLE EXCHANGEABLE METALLURGICAL VESSEL AND METHOD FOR FIXING AND RELEASING A TILTABLE METALLURGICAL VESSEL", which claims the benefit of European Patent Application No. 1720905.6, filed Dec. 20, 2017, each of which is incorporated by reference in its entirety.

BACKGROUND OF THE INVENTION

1. Field of the Invention

The present invention relates to the sector of metallurgical installations, more specifically to a metallurgical vessel for molten metals.

2. Description of the Related Art

On the one hand, the invention relates to a tiltable metallurgical vessel having a round cross section, wherein the metallurgical vessel is—at least partially—surrounded by a support ring, and the support ring is at a distance from the metallurgical vessel in the radial direction.

On the other hand, the invention relates to a method for fixing a tiltable metallurgical vessel on a support ring, and to a method for releasing a tiltable metallurgical vessel from the support ring.

Tiltable metallurgical vessels are used to produce metals—especially in steel production. These metallurgical vessels are held by a support ring, which surrounds said vessels. The support ring is at a distance from the vessel since the metallurgical vessel expands due to high operating temperatures of the molten metal. To receive molten steel, the metallurgical vessel is provided with a lining. This lining must be renewed at certain intervals. Particularly in the case of metallurgical vessels for the AOD (argon oxygen decarburization) process, for the production of stainless steels, frequent replacement of the lining is required. In order to avoid losing too much production time, the metallurgical vessel is separated from the support ring, and a new vessel with a renewed lining is installed. There are various embodiments for securing the metallurgical vessel on the support ring. In EP29878 B1, a nonpositive joint is shown, which is maintained by means of hasp screws. The disadvantage of this joint is that the release of the screws is performed manually, and thus the metallurgical vessel must first be cooled before fitters can undo the screws. To be able to carry out this release of the hasp screws, a number of safety measures have also to be performed by the fitters to minimize the risk of accidents. All this work and these measures take time and thus reduce productivity. EP 1533389 A1 discloses an automatic clamping device. In this case, locking brackets, through which a stud bolt—which is mounted on the support ring—passes, are welded onto the metallurgical vessel. The stud bolt has a wedge-shaped passage opening in the horizontal direction, and the locking bracket likewise has an opening. By means of this passage opening, a wedge is pushed through the locking bracket and the stud bolt. The wedge is moved by a hydraulic cylinder—which is mounted in a fixed location on the support ring. The disadvantage of this device is that relatively large heat-related deformations of the metallurgical vessel lead to deformations of the locking bracket and of the stud bolt, and connection and separation of the locking bracket and the stud bolt is then only possible with difficulty, or it is first necessary to wait for cooling—until the metallurgical vessel has re-assumed almost the original dimensions.

SUMMARY OF THE INVENTION

It is the object of this invention to make available a tiltable exchangeable metallurgical vessel which is fixed on a support ring so that reliable fixing of the metallurgical vessel to the support ring and likewise reliable release is made possible, despite large temperature differences.

The object is achieved in the case of the tiltable metallurgical vessel mentioned at the outset by virtue of the fact that the metallurgical vessel has at least three brackets with at least one pin. The support ring likewise has at least three receiving openings. The pins can penetrate into these receiving openings, wherein the receiving openings permit shifting of the pin in the radial direction. The metallurgical vessel has a circular cross section, and the support ring has a circular design, at least in part. The support ring can be in the form of a circular ring or can be open on one side and have a U-shaped or horseshoe-like design. When heated, the diameter of the metallurgical vessel expands, leading predominantly to radial shifting of the brackets and thus of the pins.

A floatingly mounted locking device arranged inside the support ring ensures that the pin is secured against falling out of the receiving opening and of the bracket. In addition, the floatingly mounted locking device can clamp the pin in such a way that the bracket is pressed onto the support ring via the pin.

The receiving openings should be configured in such a way that they are larger than the dimensions of the pin. In the radial direction of the support ring, the receiving opening is of significantly larger design than the dimensions of the pin in this direction. In relation to this invention, the radial direction is interpreted to mean the direction from the internal radius of the support ring in the direction of the external radius of the support ring. This configuration is intended to allow relative movements between the support ring and the metallurgical vessel that are caused by deformation or thermal expansion.

If the metallurgical vessel is relined, the temperature range at the outer surface at room temperature and during operation when there is molten metal in the metallurgical vessel is up to 400° C. Due to heat radiation from the metallurgical vessel, the support ring, in particular, is heated up on the side facing the metallurgical vessel. This likewise leads to expansions of the support ring. The relative movements are thus initiated both by movements of the metallurgical vessel and by the support ring. The floatingly mounted locking device inside the support ring ensures that the relative movements are followed even during operation. In this context, "floatingly mounted" is interpreted to mean anything suitable for allowing relative movements. Thus, "floatingly mounted" is interpreted to mean that the locking device is held in a floating bearing assembly in the support ring in a position which secures the pin against falling out of the receiving opening and follows relative movements—of the pin relative to the support ring—at least in the radial direction of the support ring. In the context of the invention, "floatingly mounted" is interpreted to mean that the locking device is not secured in a fixed location on the support ring but can move at least in the radial direction of the support ring. When the metallurgical vessel is released from the support ring, this floatingly mounted locking device is held temporarily by holding devices. It is possible, for example, for such temporary holding devices to be surrounding guides which do not hinder the compensation of the relative movements—preferably in the radial direction—during operation. If this locking device were mounted in a fixed location—as in EP 1533389 A1—this could lead to problems.

Owing to relative movements between the support ring and the metallurgical vessel, there can be deformations of a component, and thus the release of the locking device would no longer be possible, or it could lead to damage to other components. During the fixing of the metallurgical vessel on the support ring, relatively light securing of the pin can be ensured by means of the floatingly mounted locking device. A pin, wedge or similar can be provided as a securing element. The pin must be of appropriate design to ensure that the securing element can be connected to the pin.

During the operation of the metallurgical vessel, when there is molten metal therein, thermal expansions occur. During operation, the metallurgical vessel is moved—e.g. by tilting, vibrations that occur etc. —leading to changes in the loads on the pin and the support ring. These changes in the loads additionally promote further slippage of the floatingly mounted locking devices. These movements promote the avoidance of constraining forces that arise. The constraining forces are prevented by the further slippage of the floatingly mounted locking device.

In a particularly advantageous embodiment, the pin is supposed to have a wedge pressure surface, and the floatingly mounted locking device is supposed to have a wedge. To secure the pin against falling out of the receiving opening and of the bracket, the wedge is brought into connection with the wedge pressure surface. Possible embodiments of the wedge pressure surface are a lateral passage opening or at least one lateral groove. The lateral passage opening or the lateral groove are preferably of wedge-shaped design.

The floating mounting of the locking device allows compensation to enable the wedge to align itself as it is brought into connection with the wedge pressure surface. This has the advantage that there is no need to exert any constraining forces if the alignment of the wedge and of the wedge pressure surface do not coincide exactly. As the wedge is pushed in, the floatingly mounted locking bracket aligns itself automatically. Just before a desired end position of the wedge on the wedge pressure surface is reached, the locking device is pressed against an end position limit. This end position limit makes it possible to exert a corresponding force to enable the wedge to be pressed onto the wedge pressure surface of the pin. While the wedge and the wedge pressure surface are being brought into connection, the floatingly mounted locking device can likewise already be resting on the end position limit. "Bringing into connection"—in the case of a lateral passage opening for example—is interpreted to mean that the wedge is pressed into the lateral passage opening. The wedge and the wedge pressure surface are embodied in such a way that preloading in the longitudinal direction of the pin can be achieved, that is to say that the bracket is pressed onto the support ring.

In the context of this invention, a "lateral passage opening" is interpreted to mean anything which is suitable to allow a wedge to penetrate. The lateral passage opening should extend over the entire cross section to enable at least part of the wedge to pass through the pin. An end position limit is likewise necessary for the release of the pin-wedge joint. It is advantageous if the end position limit for release is situated opposite the end position limit for fixing.

A preferred embodiment envisages that the locking device comprises a main body having a main body opening, through which the pin can pass. A cylinder is mounted on the main body, and the cylinder is connected directly to the wedge. This embodiment has the advantage that the pin passes through the main body opening of the main body, and the wedge is pressed onto the wedge pressure surface when the cylinder is actuated. The main body opening serves as an end position limit, which serves to press the wedge onto the wedge pressure surface in an appropriate manner—by means of the cylinder. An edge or edge surface of the main body opening—that situated opposite a fastening of the cylinder—is pressed against the pin during the pressing-in process. This ensures that the cylinder can produce the appropriate force to press the wedge in. This embodiment represents a very simple and space-saving design. This embodiment is particularly suitable for small metallurgical vessels with a correspondingly small support ring.

In a particularly preferred embodiment, the receiving openings of the support ring are elongate holes. These elongate holes extend in the radial direction. This is a particularly preferred embodiment for ensuring the relative movement of the pin and the support ring and thus for avoiding constraining forces.

It is advantageous if the dimension of the receiving opening in the radial direction is at least twice as large as the dimension of the pin in the radial direction. It should at least be ensured that a relative movement of at least the dimension of the pin in the radial direction is possible.

In a particularly advantageous embodiment, a distance sleeve, through which the pin projects, is used on the bracket.

The pin is supported on the distance sleeve instead of on the bracket. The distance sleeve is embodied in such a way that the pin can project through but a head of the pin is supported on the sleeve. It is also conceivable for the distance sleeve to be situated between the bracket and the support ring.

This embodiment has the particular advantage that the pin can be severed above the support ring to enable the metallurgical vessel to be lifted off in the event of unforeseen circumstances—in the event of a fault in the cylinder for example. The distance sleeve should have a height of at least 50 mm By virtue of this distance sleeve, accessibility is good, and the support ring and the remainder of the metallurgical vessel are not damaged by the severing process. In this embodiment, the severing process can be performed with a flame cutter, for example.

One advantageous embodiment envisages that the locking device has a position monitoring device. This position monitoring device ensures at all times that the pin is secured against falling out of the receiving opening and of the bracket.

One specific embodiment envisages that the metallurgical vessel has four brackets with pins, and the support ring has four receiving openings. In order to enhance safety, a fourth bracket with a pin is attached in order to ensure secure connection of the support ring and the metallurgical vessel if one pin fails. The fourth pin is of redundant design and enhances the security of the connection between the support ring and the metallurgical vessel, and thus, if one pin-wedge joint fails or if there are cracks in a bracket, safe operation is nevertheless ensured.

Another preferred embodiment envisages that the position monitoring device is implemented by means of a pressure measuring device and of a position monitoring device of the cylinder. The pressure measuring device serves to ensure that there is a certain minimum pressure applied to the cylinder during operation. The pressure measuring device also monitors that a maximum pressure is not exceeded. If a fixed maximum pressure is exceeded, this could lead to a problem during the removal of the wedge from the wedge pressure surface. If the wedge is pressed in too hard, the force may no longer be sufficient to pull the wedge out. The position monitoring device can be implemented by direct measurement of a position of a piston rod of the cylinder, for example, or, alternatively, by measuring the flow rate of the fluid with which the cylinder is supplied. Measuring the flow rate enables the position of the wedge to be determined.

One particularly preferred embodiment of the metallurgical vessel is an argon oxygen converter which has a holding capacity of up to 180 t. In the case of argon oxygen converters (AOD), frequent exchange is necessary since the lining is subject to severe wear. The metallurgical vessels are usually smaller than metallurgical vessels for other steel production methods.

The smaller metallurgical vessels for AOD converters thus also have a smaller support ring. The space requirement within the support ring is smaller, as a result of which the floatingly mounted locking device described is particularly well-suited to AOD converters.

The object according to the invention is also achieved by the method mentioned at the outset, which comprises the following steps. A metallurgical vessel which has at least three pins is brought into connection with a support ring. The support ring has receiving openings for pins. As the vessel is mounted, the pins penetrate into the receiving openings. As soon as the metallurgical vessel is resting on the support ring, each pin is secured against falling out of the bracket and of the receiving opening by locking devices floatingly mounted inside the support ring, whereby fixing of the metallurgical vessel on the support ring is performed. Each pin should be secured in such a way that, as far as possible, no play occurs between the support ring and the bracket. This means that securing is performed in such a way that the pin is as far as possible preloaded. A movement along a longitudinal axis of the pin should be prevented. In this way, the support ring and the metallurgical vessel are fixed to one another. During operation of the metallurgical vessel, relative movements between the pin and the support ring are followed by the floatingly mounted locking device, with the result that, by virtue of this relative movement, the floatingly mounted locking device tracks the relative movement of the pin in relation to the support ring. In this context, relative movements, arising from thermal expansions, for example, between the bracket with the pin and the support ring in the radial direction of the support ring should be made possible. Enabling these relative movements serves to avoid unwanted deformations of components of the joint between the metallurgical vessel and the support ring.

One advantageous embodiment of the method envisages that the floatingly mounted locking device is continuously monitored by means of a position monitoring device. It is thereby possible to rapidly detect possible problems in the securing of the pin against falling out of the bracket and of the receiving opening while operation is in progress.

One particularly advantageous embodiment envisages that the floatingly mounted locking device has a wedge, and the wedge is pressed in with a maximum of 75% of an available maximum force—for removing the wedge.

Limiting the force to a maximum of 75% of the available maximum force for removing the wedge ensures that there are still reserves of force available for removing the wedge from the lateral passage opening or from a lateral groove of the pin. When using a double acting cylinder, only a reduced force is possible in one direction owing to the piston rod. The piston rod reduces the effective area of the piston.

The object according to the invention is achieved by the method mentioned at the outset for releasing a fixing of the metallurgical vessel from the support ring. The fixing of pins by floatingly mounted locking devices is released. In the case of a pin-wedge joint, for example, the wedges are removed from the wedge pressure surface of the pins by the floatingly mounted locking devices. The metallurgical vessel is subsequently lifted off the support ring. An embodiment with floatingly mounted locking devices makes release significantly easier since permanent deformations are largely avoided by virtue of the floatingly mounted locking devices.

BRIEF DESCRIPTION OF THE DRAWINGS

Further advantages and features of the present invention will become apparent from the following description of non-limitative illustrative embodiments, wherein reference is made to the following figures, which show the following.

DETAILED DESCRIPTION

Figure 1:
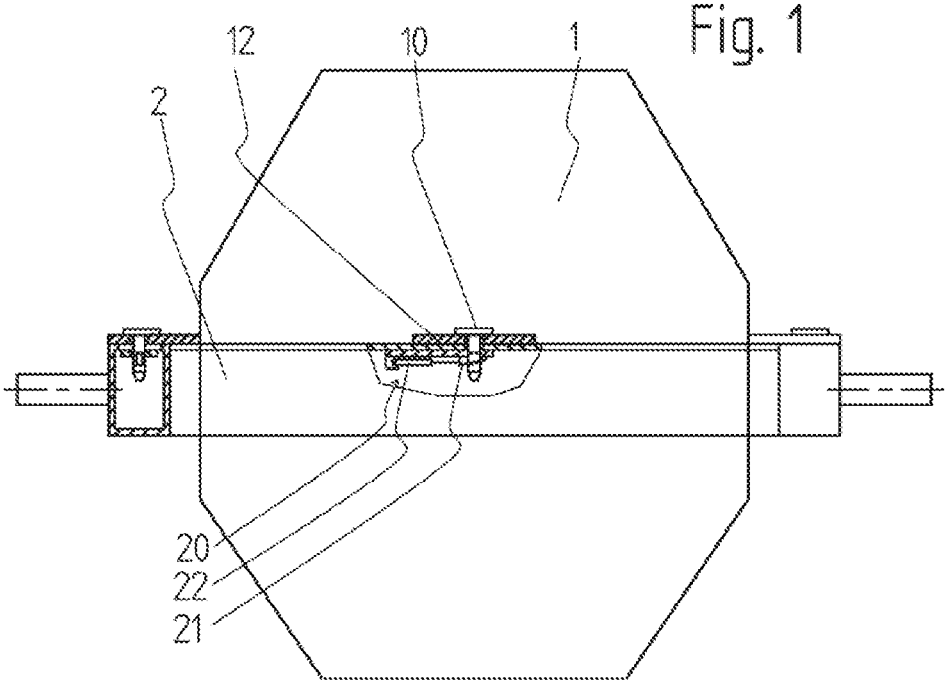
FIG. 1 shows a schematic illustration of a converter with a support ring.
Figure 1:
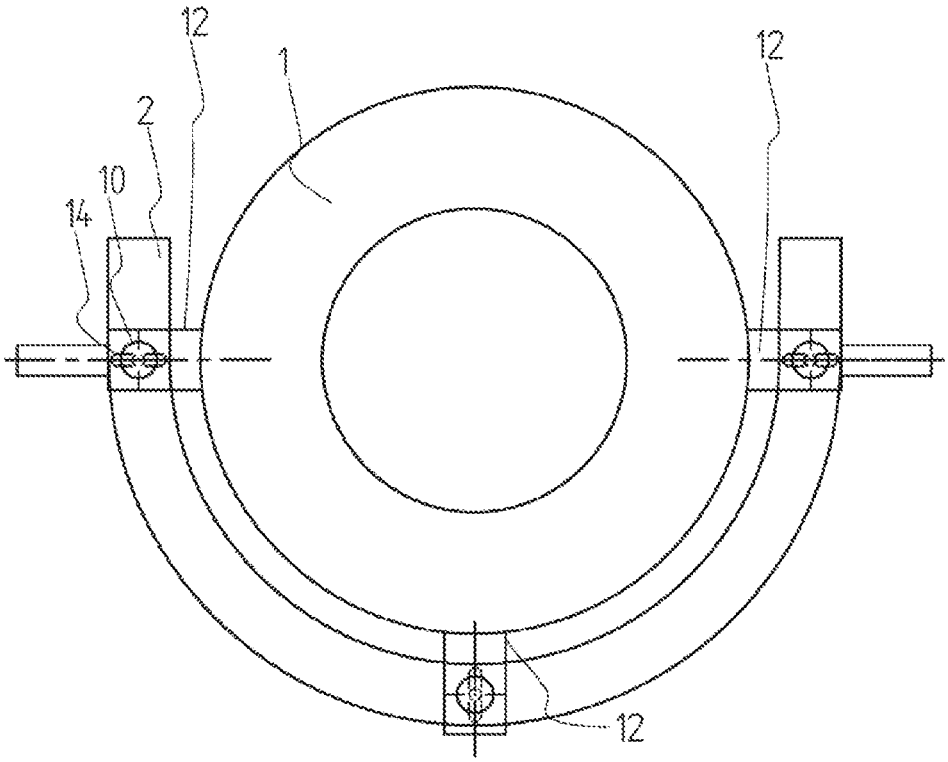

FIG. 1 shows a metallurgical vessel 1 and a support ring 2. The metallurgical vessel 1 has three brackets 12 and is connected to the support ring 2, which has three receiving openings 14, by three pins 10. The pins 10 are each secured against falling out of the bracket and of the receiving opening 14 of the support ring by means of a floatingly mounted locking device 20. The floatingly mounted locking device 20 has a cylinder 22 and a wedge 21. The pin 10 is fixed by the wedge 21.

Figure 2:
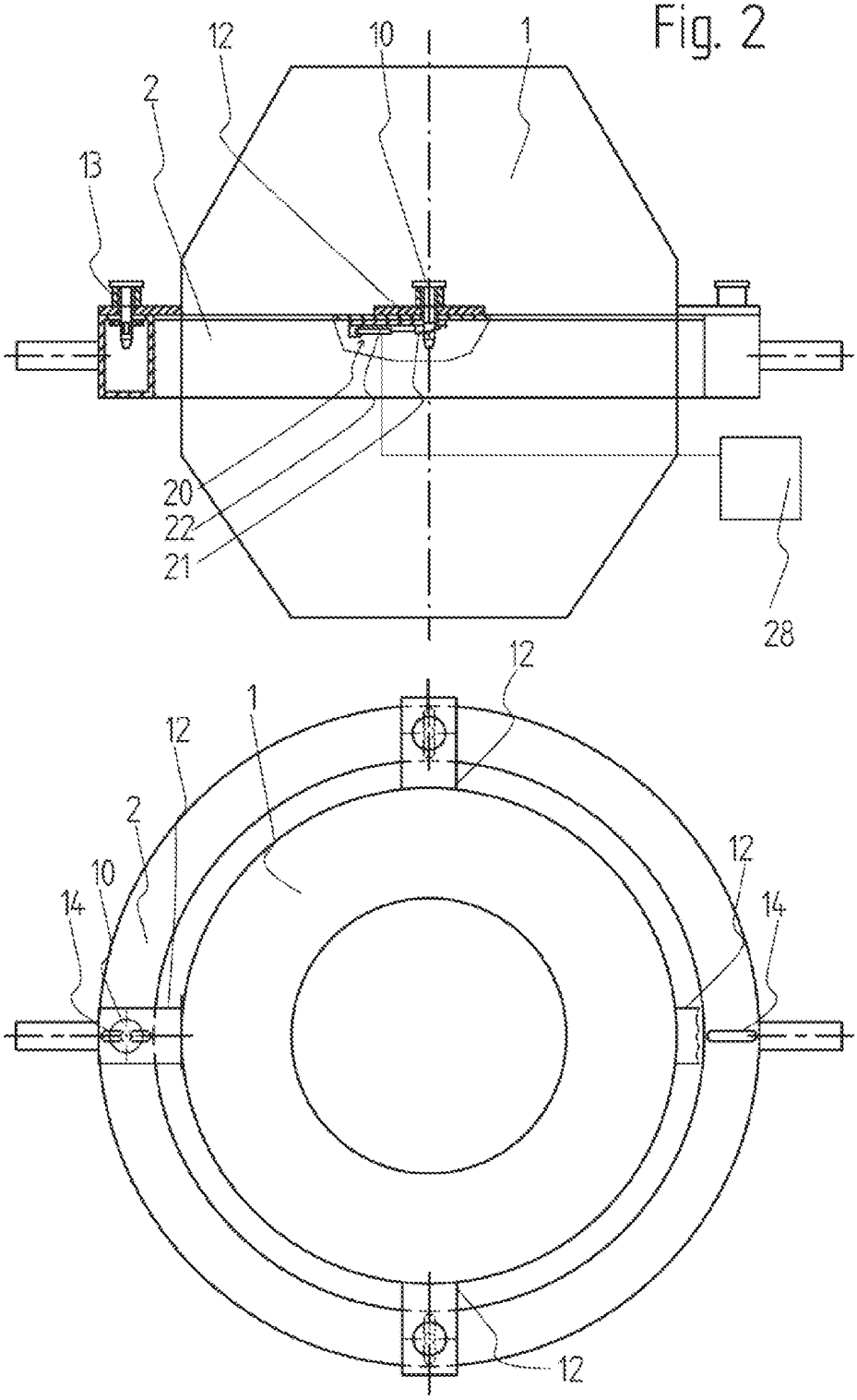
FIG. 2 shows a schematic illustration of a metallurgical vessel with a closed support ring and four brackets and pins arranged on the circumference.

A further embodiment of the connection of a metallurgical vessel 1 to a support ring 2 is shown in FIG. 2. This embodiment differs in that the support ring 2 is closed. Another difference is that a distance sleeve 13 is mounted between the pin 10 and the bracket 12. This distance sleeve 13 serves to enable the pin 10 and the distance sleeve 13 to be severed, by means of a flame cutter for example, if the floatingly mounted locking device 20 fails. The receiving openings 14—which are designed as elongate holes—extend in the radial direction in order to allow a relative movement of the bracket and the pin in relation to the support ring. A position monitoring device 28 ensures that the wedge 21—pin 10 joint is always maintained in order to prevent the pin from falling out of the bracket 12 and of the receiving opening 14. All other reference signs have already been explained in the description of FIG. 1.

Figure 3:
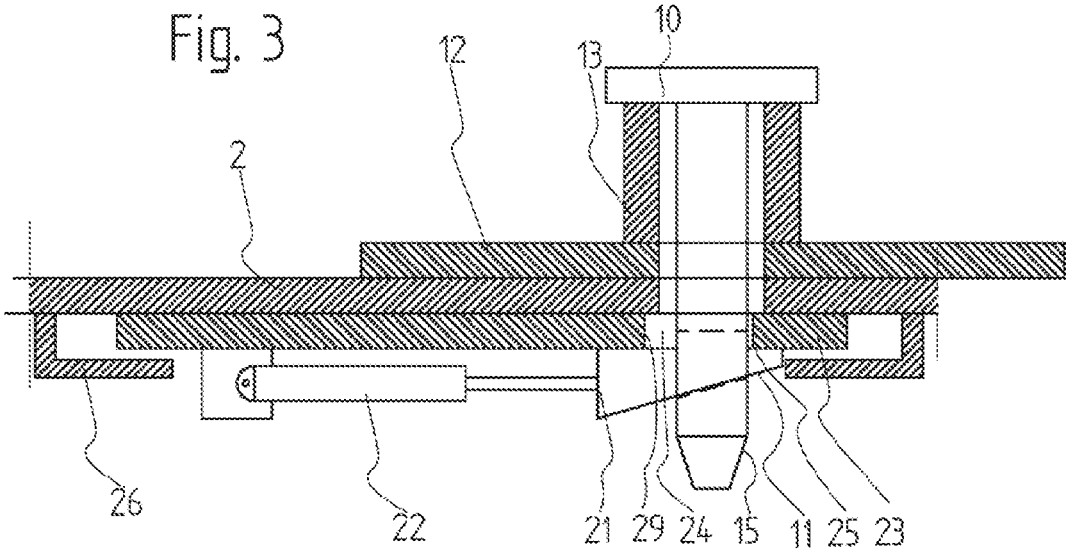
FIG. 3 shows an enlarged schematic view of a floatingly mounted locking device and of a pin.

In FIG. 3, the connection between the pin 10 and the floatingly mounted locking device 20 is illustrated on an enlarged scale. The cylinder 22 is mounted on a main body 23. The cylinder 22 is connected directly to a wedge 21. This main body 23 has a main body opening 24, which has an end position limit 25, and an end position limit for release 29 is likewise illustrated. The pin has a wedge pressure surface 11, which serves to press the pin 10 in firmly—via the wedge 21—and thereby to fix the connection between the support ring 2 and the metallurgical vessel. The pin 10 and the main body opening 24 each have insertion chamfers. These insertion chamfers 27, 15 serve to ensure that the floatingly mounted locking devices 20 are centered as the pins 10 are inserted. These insertion chamfers 27, 15 are just one possibility, and it is also conceivable to use different insertion aids. When the wedge 21 is not pressing on the wedge pressure surfaces 11, the floatingly mounted locking device 20 is held in position by holding devices 26. It is also conceivable, for example, for the holding device 26—as illustrated—to be a surrounding guide 26 and simultaneously to act as an end position limit if the main body 23 does not have a main body opening 24.

Figure 4:
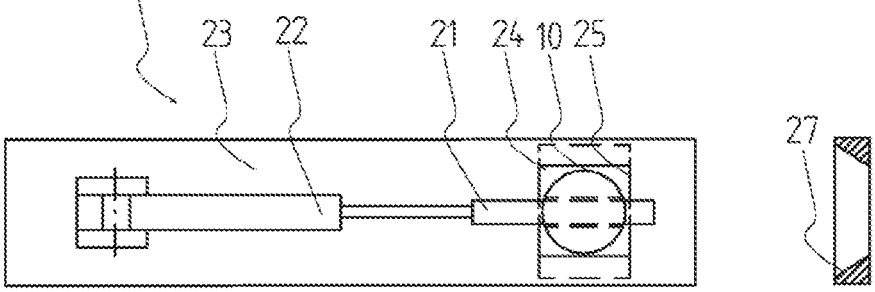
FIG. 4 shows a plan view of the floatingly mounted locking device.

FIG. 4 is a plan view of the floatingly mounted locking device 20. In this illustration, the essential components, such as the cylinder 22, the wedge 21, the main body 23 with the main body opening 24 and the end position limit 25 are illustrated. The reference signs in FIG. 4 have already been explained in FIG. 3.

Figure 5A:
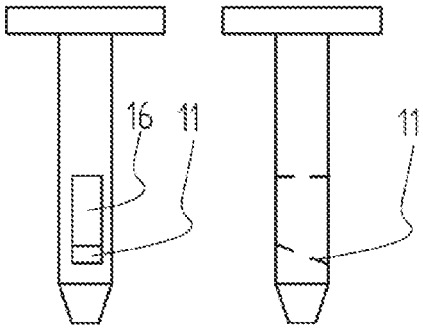
FIGS. 5*a*-5*d* show various embodiments of pins with wedge pressure surfaces and associated wedges.
Figure 5B:
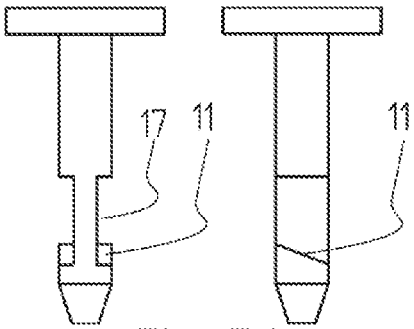
Figure 5C:
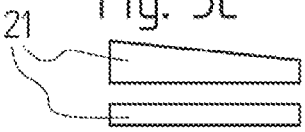
Figure 5D:
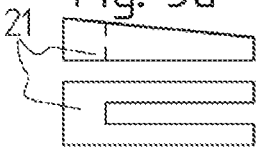

Possible embodiments of the pin 10 and of the wedge pressure surface 11 are illustrated in FIGS. 5*a* and 5*b*. A passage opening 16 through the pin 10 is illustrated in FIG. 5*a*. In FIG. 5*b*, the wedge pressure surfaces 11 are two lateral grooves 17. These are intended to represent just two examples of the way in which these wedge pressure surfaces 11 are embodied. It is also conceivable for the pin 10 to have just one lateral groove 17. One possible embodiment of a wedge 21—for the passage opening 16 in FIG. 5*a*—is illustrated in FIG. 5*c*. One possible embodiment of a wedge 21—for the two lateral grooves 17 in FIG. 5*b*—is illustrated in FIG. 5*d*.

Figure 6:
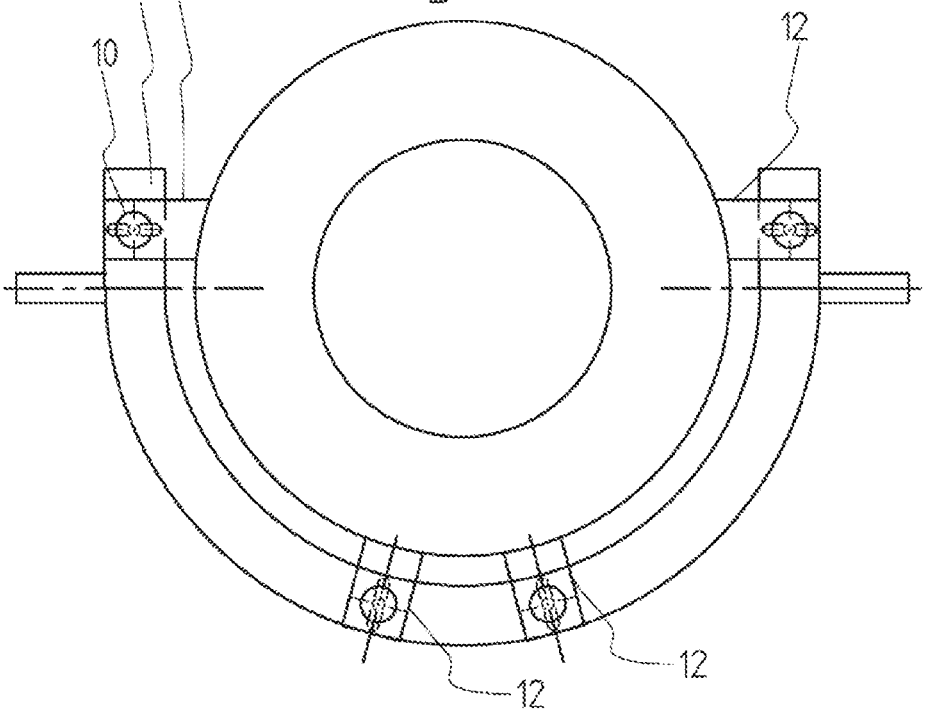
FIG. 6 shows a schematic illustration of a metallurgical vessel with an open support ring with four brackets and pins arranged on the circumference.

One embodiment of a metallurgical vessel 1 with a support ring 2 and four brackets 12 is illustrated in FIG. 6. This variant embodiment has the advantage that, if a bracket 12, pin 10 or the floatingly mounted locking device (not illustrated) fails, safe operation of the metallurgical vessel 1 fixed on the support ring 2 is still ensured.

Figure 7:
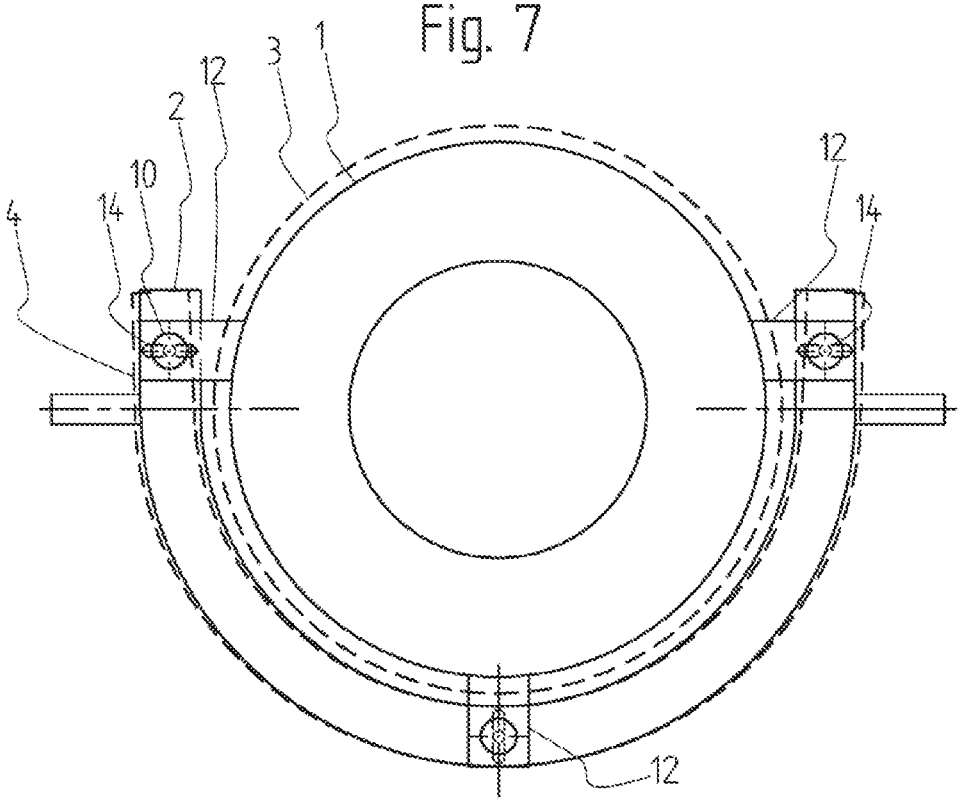
FIG. 7 shows a schematic illustration of a metallurgical vessel with an open support ring in the cold and in the hot state.
Figure 8:
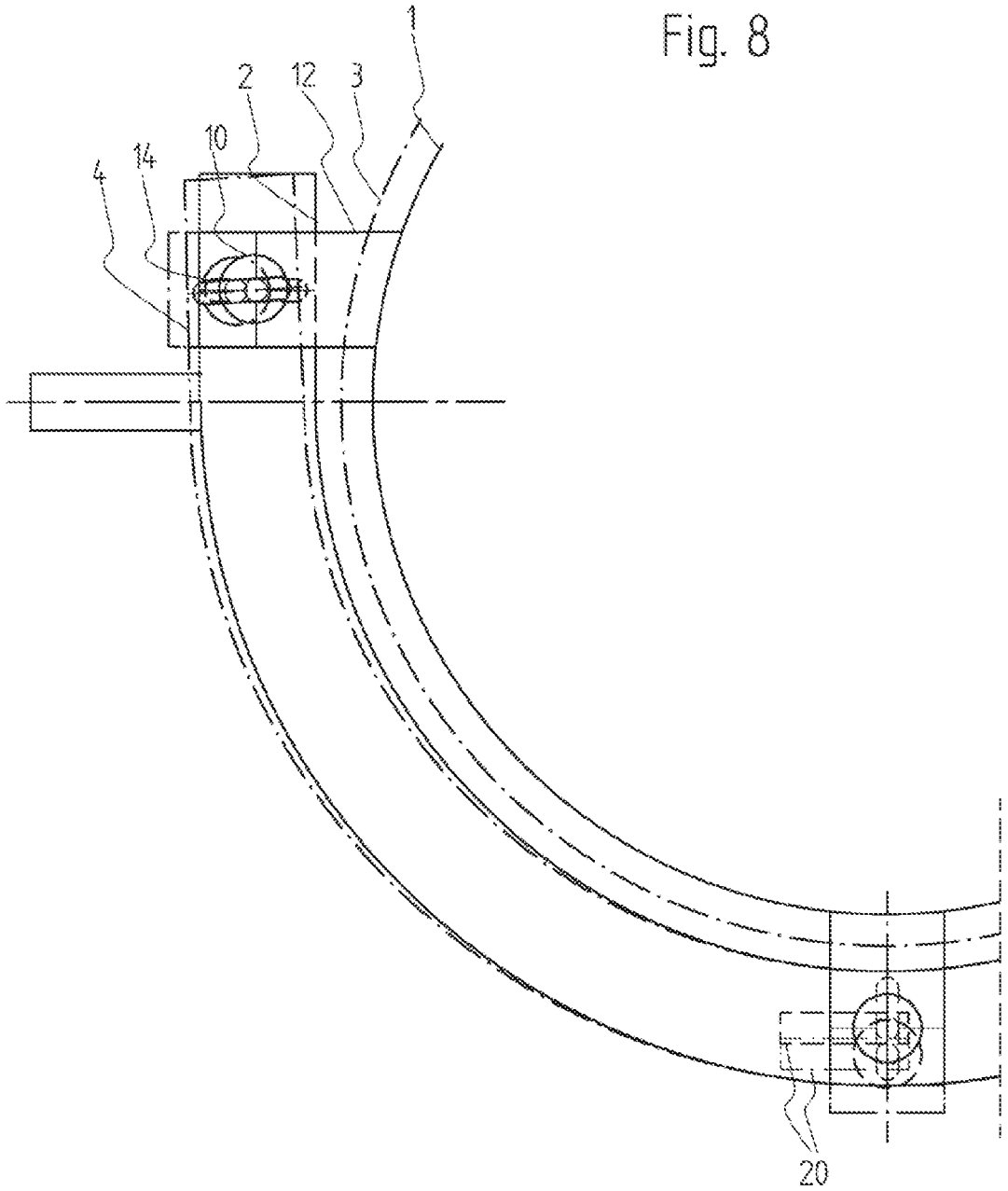
FIG. 8 shows an enlarged schematic view of a metallurgical vessel with an open support ring in the cold and in the hot state.

FIG. 7 and FIG. 8 illustrate schematically the expansion of the metallurgical vessel 1. During operation, the hot metallurgical vessel 3 has a larger diameter—represented by the chain-dotted lines.

The shape of the open support ring 2 also changes due to heat radiation from the hot metallurgical vessel 3—from a U shape to a V shape. FIG. 7 and FIG. 8 illustrate the change in the support ring as a hot support ring 4. As a consequence, the position of the pin 10 relative to the receiving opening 14 also changes. This relative movement is illustrated on an enlarged scale in FIG. 8, as is the movement of the floatingly mounted locking device 20—schematically in the lower area. It can also be seen in FIG. 8 that the relative movement of the pin 10 and the receiving opening 14 can be less in the region of the open side than, for example, in the lower area, where the locking device 20 is illustrated. FIG. 8 illustrates the radial shifting of the pin 10 in the receiving opening 14. The movement of the floatingly mounted locking device 20 to follow this radial shift is likewise visible in FIG. 8.

Although the invention has been illustrated and described more specifically in detail by means of the preferred illustrative embodiments, the invention is not restricted by the examples disclosed, and other variations can be derived therefrom by a person skilled in the art without exceeding the scope of protection of the invention.

LIST OF REFERENCE SIGNS

1 metallurgical vessel
2 support ring
3 hot metallurgical vessel
4 hot support ring
10 pin
11 wedge pressure surface
12 bracket
13 distance sleeve
14 receiving opening
15 insertion chamfer
16 lateral passage opening
17 groove
20 floatingly mounted locking device
21 wedge
22 cylinder
23 main body
24 main body opening
25 end position limit
26 holding device
27 insertion chamfer
28 position monitoring unit
29 end position limit for release

The invention claimed is:

1. A tiltable metallurgical vessel comprising:
a round cross section; and
at least three brackets, each having a respective pin;
wherein the metallurgical vessel is at least partially surrounded by a support ring, and the support ring is at a distance from the metallurgical vessel in the radial direction, the support ring having at least three receiving openings suitable for receiving the pins; and
wherein the receiving openings permit shifting of the pin in a radial direction of the support ring, and there are at least three locking devices arranged entirely inside the support ring and floatingly mounted to allow the locking devices movement at least in the radial direction, the locking devices securing the pins against falling out of the receiving opening and the bracket.

2. The tiltable metallurgical vessel as claimed in claim 1, wherein:
the pin has a wedge pressure surface;
the floatingly mounted locking devices have a wedge; and
the floatingly mounted locking device is adapted to bring the wedge into connection with the wedge pressure surface to secure the pin against falling out of the receiving opening and the bracket.

3. The tiltable metallurgical vessel as claimed in claim 2, wherein the wedge pressure surface is one of a lateral passage opening or at least one lateral groove.

4. The tiltable metallurgical vessel as claimed in claim 2, wherein the floatingly mounted locking device comprises:
a main body with a main body opening, through which the pin can penetrate; and
a cylinder mounted on the main body, the cylinder being connected directly to the wedge.

5. The tiltable metallurgical vessel as claimed in claim 1, wherein the receiving openings of the support ring are elongate holes.

6. The tiltable metallurgical vessel as claimed in claim 1, wherein the pin has a dimension in the radial direction of the metallurgical vessel, and the receiving opening is at least twice as large in the radial direction as the dimension of the pin in the radial direction.

7. The tiltable metallurgical vessel as claimed in claim 1, wherein a distance sleeve, through which the pin projects, is mounted on the bracket.

8. The tiltable metallurgical vessel as claimed in claim 1, wherein the floatingly mounted locking device has a position monitoring device.

9. The tiltable metallurgical vessel as claimed in claim 8, wherein the position monitoring device is implemented by means of a pressure measuring device and of a further position monitoring device of the cylinder.

10. The tiltable metallurgical vessel as claimed in claim 1, wherein the metallurgical vessel has four brackets with pins, the support ring has four receiving openings, and there are four floatingly mounted locking devices inside the support ring.

11. The tiltable metallurgical vessel as claimed in claim 1, wherein the metallurgical vessel is an argon oxygen converter and has a holding capacity of up to 180 t.

12. A method for fixing the tiltable metallurgical vessel on the support ring claimed in claim 1, comprising:

connecting the metallurgical vessel to the support ring in such a way that the pins penetrate into the receiving openings as soon as the metallurgical vessel is resting on the support ring; and securing the metallurgical vessel against falling out of the bracket and of the receiving opening by the floatingly mounted locking devices of each pin.

13. The method as claimed in claim 12, further comprising continuously monitoring the floatingly mounted locking device by means of a position monitoring device.

14. The method ring as claimed in claim 13, wherein the floatingly mounted locking device has a wedge for securing the pin, and the wedge is pressed in with a maximum of 75% of the available maximum force that is possible for removing the wedge.

15. The method as claimed in claim 12, further comprising:

releasing the fixing of pins by the floatingly mounted locking devices; and lifting the metallurgical vessel off the support ring.

* * * * *